United States Patent [19]

Gebelius

[11] Patent Number: 4,920,746

[45] Date of Patent: May 1, 1990

[54] EXHAUST SYSTEM FOR COMBUSTION ENGINES

[76] Inventor: Sven R. V. Gebelius, P.O. Box 15008, S-1615 Bromma, Sweden

[21] Appl. No.: 240,124

[22] PCT Filed: Mar. 4, 1987

[86] PCT No.: PCT/SE87/00107

§ 371 Date: Aug. 30, 1988

§ 102(e) Date: Aug. 30, 1988

[87] PCT Pub. No.: WO87/05357

PCT Pub. Date: Sep. 11, 1987

[30] Foreign Application Priority Data

Mar. 10, 1986 [SE] Sweden ..... 8601099

[51] Int. Cl.[5] ..... F01N 3/28

[52] U.S. Cl. ..... 60/299; 181/231; 422/180

[58] Field of Search ..... 60/299; 422/180; 181/231

[56] References Cited

U.S. PATENT DOCUMENTS

| | | | |
|---|---|---|---|
| 1,341,976 | 6/1920 | Fisher . | |
| 2,877,860 | 3/1959 | Hoffar . | |
| 3,492,098 | 1/1970 | DePalma | 422/180 |
| 3,775,063 | 11/1973 | Grout | 422/180 |
| 4,022,019 | 5/1977 | Garcea | 60/282 |
| 4,345,430 | 8/1982 | Pallo | 60/299 |
| 4,530,418 | 7/1985 | Currie | 181/231 |

FOREIGN PATENT DOCUMENTS

| | | |
|---|---|---|
| 1476600 | 10/1969 | Fed. Rep. of Germany . |
| 3319529 | 12/1983 | Fed. Rep. of Germany . |
| 646808 | 11/1928 | France . |
| 989017 | 9/1951 | France . |

*Primary Examiner*—Douglas Hart

*Attorney, Agent, or Firm*—Fleit, Jacobson, Cohn, Price, Holman & Stern

[57] ABSTRACT

Exhaust system for combustion engines, which comprises of a longtiudinally extending tubular member (1), in direction from a first end portion having a number of smooth portions (2, 2') alternating arranged with corrugated portions (3, 3'). At least one insert is arranged insertable into the longitudinally extending tubular member (1), held in inserted position substantially only by means of frictional contact between inserted insert and surrounding tubular member (1). The insert is arranged to cause exhaust fumes flowing through the tubular member (1) from the combustion engine to receive a changed chemical composition by means of catalytic action and/or to reduce the exhaust sound level by a change in the flow characteristics for the exhaust fumes. The corrugated portions (3, 3') are advantageously arranged including a non-corrugated portion, forming a smooth and non-corrugated surface extending in longitudinal direction of the tubular member, which is located as a lower surface when the exhaust system is installed.

21 Claims, 3 Drawing Sheets

EXHAUST SYSTEM FOR COMBUSTION ENGINES

CROSS REFERENCE TO RELATED APPLICATION(S)

This United States application stems from PCT International Application No. PCT/SE87/00107 filed Mar. 4, 1987.

The present invention relates to an exhaust system for combustion engines.

Previously known exhaust systems, for example as used in motor vehicles, include exhaust pipes, but also silencers. The exhaust pipe normally comprises of at least two tubular lengths, having a length and extension adapted to suit a certain type of vehicle. Between adjacently located end portions of the exhaust pipe lengths, a silencer is attached by means of clamping joints, usually including a U-shaped member, against which a clamping member can be secured by means of two nuts. It should also be mentioned, that a catalytic unit for purification of the exhaust fumes may be included in certain types of exhaust systems, attached correspondingly to a silencer between two adjacently located exhaust pipe lengths. For a motor vehicle having catalytic purification of the exhaust fumes, an exhaust system may thus include a first length of exhaust pipe extending from the exhaust manifold, a catalytic unit, a short length of exhaust pipe, a first silencer, a short length of exhaust pipe, a second silencer, and a final length of exhaust pipe. Such an exhaust system is manufactured adapted for use with regard to a certain type of vehicle, and can not be used for any other type of vehicle. As a result, numerous types of exhaust systems are manufactured/stored, each one adapted for use with regard to a specific car model, and there are also differences existing between the manufacturing year of certain car models.

There are a number of disadvantages related to these known types of exhaust systems, and a major disadvantage is obviously the large number of types that must be manufactured/stored, both with regard to lengths of exhaust pipes, types of silencers, and types of catalytic units. A further disadvantage is related to the large number of joints existing between included parts of an exhaust system, which result in sealing problems, and also points where damage occur, caused by fatigue or corrosion. The problem of damage caused by corrosion is accentuated in conventional types of exhaust systems, particularly during short distance travel, due to the formation of condensed liquid corrosive products, which remain within the exhaust system. Difficulties in separating joined parts may for example also result in that a part included in an exhaust system can not be removed for replacement when damage has occured, unless it is cut off, and as a result, also adjacently located parts of the exhaust system must be replaced. It is also well known, that installation of a new exhaust system, as replacement for an old and damaged system, often can not be carried out without access to gas welding equipment or similar type of heat source, since final adjustment by heating and bending of included exhaust pipe lengths is required. The fashion in which silencers and catalytic units extend outwardly from the exhaust pipe with a considerably larger cross-sectional area often also results in damage of same when driving across uneven ground, and in certain cases, the entire exhaust system is pulled loose or damaged. Catalytic units utilized for purification of the exhaust fumes are particularly easy to damage, since included thin ceramic elements should not be subjected to pressure or striking forces, and the costs involved for replacement of such a unit are considerably high.

The object of the present invention is to disclose an exhaust system which can be adaped to suit various requirements of use, and thus also various vehicle models. The exhaust system according to the present invention does not include previously used joining members, comprising only one individual length of pipe, and adaption to desired longitudinal configuration of extension can be carried out without access to a heat source. It is further possible to tune the counter-pressure required in an exhaust system to suit every individual type of engine, in order to obtain maximum effect for the engine. The cross-sectional area of the exhaust system is maintained substantially unchanged and without any increases in area of the type that for example silencers previously caused. It is further possible to accomplish catalytic purification of the exhaust fumes at a considerably reduced costs in relation to commonly used techniques, and existing condensed corrosive products may also be substantially completely removed.

The exhaust system according to the present invention is mainly characterised in that it comprises of a longitudinally extending tubular member, in direction from a first end portion having a number of smooth portions alternating arranged with corrugated portions, said first end portion being arranged to facilitate attachment against the exhaust manifold of a combustion engine, and at least one insert being arranged insertable into the longitudinally extending tubular member, arranged to be held in inserted position by means of preferably only frictional contact between inserted insert and surrounding tubular member, said insert being arranged to cause exhaust fumes flowing through the tubular member from the combustion engine to receive a changed chemical composition by means of catalytic action and/or to reduce the exhaust sound level by a change in the flow characteristics for the exhaust fumes.

A number of examples of embodiments of an exhaust system according to the present invention will be more fully described below with reference to the accompanying drawings, in which.

The exhaust system according to the present invention includes an outer casing comprising a longitudinally extending tubular member, as a complete unit denominated 1, including alternating arranged smooth portions 2, 2' and corrugated portions 3, 3'. Advantageously, the corrugated portions 3, 3' are arranged only partly surrounding the tubular member 1, thereby forming a smooth and non-corrugated portion extending in longitudinal direction of the tubular member 1, as indicated by A in FIG. 1.

Figure 2:
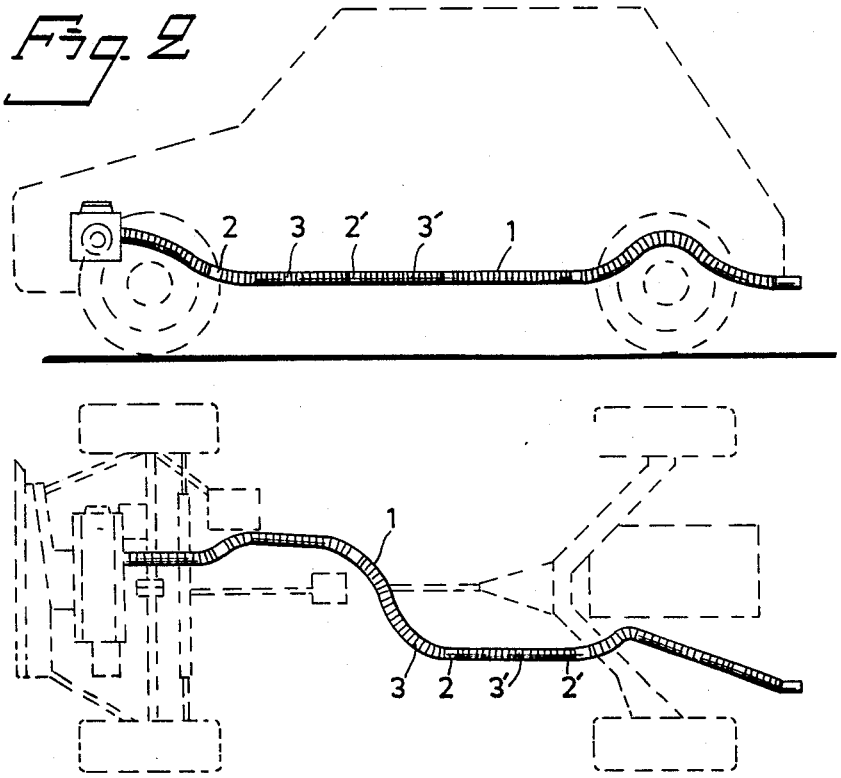
FIG. 2 shows in combination a schematical side view and a plan view of a car having an exhaust system according to the invention.

Such a tubular member 1 can be manufactured from a relatively thin sheet metal material, and advantageously from a stainless steel material, and due to the existing corrugated portions 3, 3' it may be easily shaped into desired longitudinal configuration of extension, e.g. as exemplified in FIG. 2. When the tubular member 1 includes the aforementioned non-corrugated portion A, same is located as a lower and the ground surface adjacent part when installed. Attachment of the tubular member 1 to the combustion engine is made possible by arranging at least the end portion adjacent to the combustion engine as a non-corrugated smooth portion 2, 2'.

Figure 1:
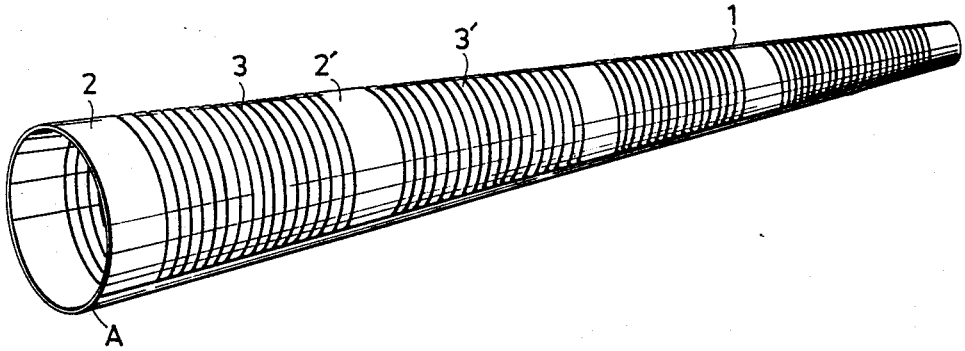
FIG. 1 shows a perspective view of an embodiment of an exhaust pipe according to the present invention.

In order to accomplish a sound silencing effect, the tubular member 1 described with reference to FIGS. 1 and 2, as from now referred to as the exhaust pipe, must also include a sound damping insert. Such an insert is mounted by insertion into the exhaust pipe 1, and an example of such an insert and the method of installation is illustrated in FIGS. 3A–3D.

The installation is preferably carried out while the exhaust pipe 1 has a substantially linear extension (FIG. 3A), when an insert, as a complete unit denominated 4, is inserted from one end portion of the exhaust pipe 1. Such an insert 4 may comprise of a longitudinally extending member of cushion-shaped parts, 5, 5' of a woven threadshaped material having elastic properties, which surround bodies having spherical, tubular or any other desired configuration, and this also includes bodies having one or several through holes, bodies having a porous structure, and bodies formed from threadshaped material. Such bodies are advantageously manufactured from a ceramic material, but also other temperature resistant materials can obviously be used, particularly with regard to bodies of threadshaped material, in which metallic materials obviously are preferred, and with the threadshaped material preferably arranged in a random internal relationship, whereby a configuration resembling "steel wool" is accomplished.

Figure 3A:
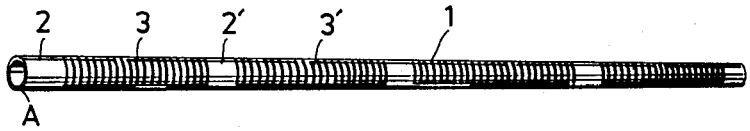
FIG. 3A shows a perspective view of the tubular and outer part of the exhaust system.
Figure 3B:
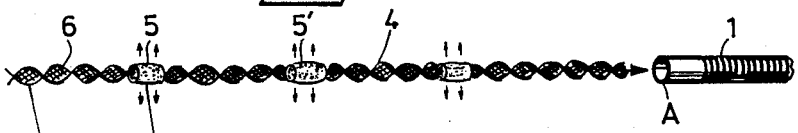
FIG. 3B shows a perspecive view of an example of an embodiment of an insert intended to be inserted in the direction indicated by means of an arrow into a tubular part of the type shown in FIG. 3A.
Figure 3C:
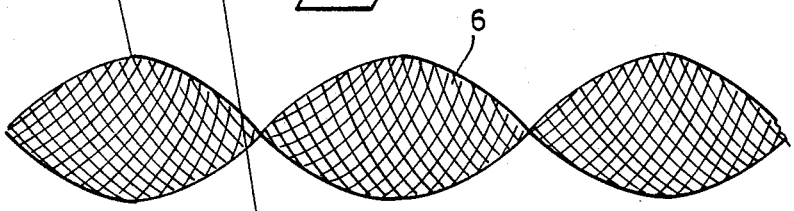
FIG. 3C shows a perspective view in enlarged scale of a part of the insert shown in FIG. 3B.
Figure 3D:
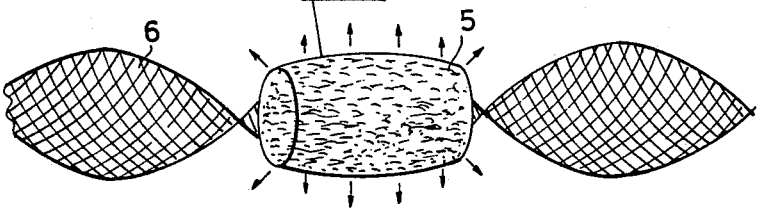
FIG. 3D shows a perspective view corresponding to FIG. 3C of a successively following part of the insert shown in FIG. 3B.

During the insertion into the exhaust pipe 1, a first end portion of the insert 4 is attached to a string or similar, which is moved through the exhaust pipe 1. When a pulling force is applied to the string, the insert 4 is stretched to an increased length, and thus also a reduced diameter, preferably to a cross-sectional area smaller than the internal area of the exhaust pipe 1, and while maintaining the pulling force applied, the insert 4 can be moved into a suitable position of location within the exhaust pipe 1, whereafter the force maintaining the insert 4 stretched is removed. The elastic properties of the cushion-shaped parts 5, 5' casings will now cause same to expand diametrically when the length extension is reduced, whereby the cushion-shaped parts 5, 5' are pressed against the internal surface of the exhaust pipe 1. This diametrical expansion is illustrated by arrows for certain of the elements included in the insert shown in FIG. 3B, and also in FIG. 3D. The portions which are shown non-expanded may comprise of a metal strip 6 twisted into a helical line configuration, as shown in FIG. 3C, arranged in lengths connected to cushion-shaped parts 5, 5', and such a connection is shown in FIG. 3D.

The cushion-shaped parts 5, 5' receive an extremely favourable grip against the internal surface of the exhaust pipe 1, due to existing corrugated portions 3, 3', which prevent the insert 4 from moving within the exhaust pipe 1. In combination with the metal strips 6, twisted into a helical line configuration, the cushion-shaped parts, 5, 5', with existing filling or bodies facilitating byflow of combustion gases, result in a good sound damping effect. The spacing between the cushion-shaped parts, 5, 5' may advantageously be arranged non-equal, in order to achieve an improved sound damping effect.

The above mentioned cushion-shaped parts 5, 5' may also, for example, be arranged filled with ceramic bodies, having a platinum coating, in order to serve as an exhaust fume purifying catalyst, and such a coating may obviously also be applied to intermediately located helically twisted metal strips 6. As previously known, a platinum type catalyst requires a temperature in the region of 250°–300° C. to operate efficiently, and by extending the length of the catalyst along the total length of the exhaust system, a resulting advantage is that a favourable temperature always exists at one part of the catalyst. It should also be mentioned, that the coating obviously need not be platinum, and that also coatings of platinum-rhodium may be used, as well as other known catalyst materials.

Figure 4:
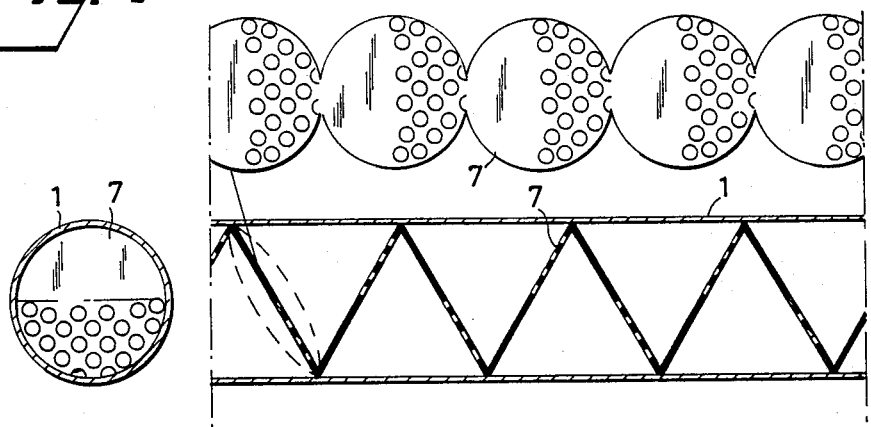
FIG. 4 shows in combination a plan view of a second embodiment of an insert, said insert being arranged within the exhaust pipe, shown in longitudinal section, and also shown in cross-section.

Apart from metal strips 6 twisted into a helical line configuration, also other types of insert means may be used, and FIG. 4 shows a strip of internally connected circular blanks 7, having the surface partly perforated, which also can be used. Such a strip can be arranged having a zig-zag-shaped extension within the exhaust pipe 1, with the perforations in adjacently located blanks arranged alternately directed upwards/downwards in relation to each other. Such a design causes a continuously varied flow direction for the exhaust fumes, and result in good sound damping properties. The strip 7, bent into zig-zag-shape, will also grip favourable against the internal surface of the exhaust pipe 1, and particularly well against the corrugated portions 3, 3' of the exhaust pipe 1. The strip 7 is easily inserted into the exhaust pipe 1 by stretching same to an increased length, from which same is allowed to resiliently take up a position gripping against the internal surface of the exhaust pipe 1.

Figure 5:
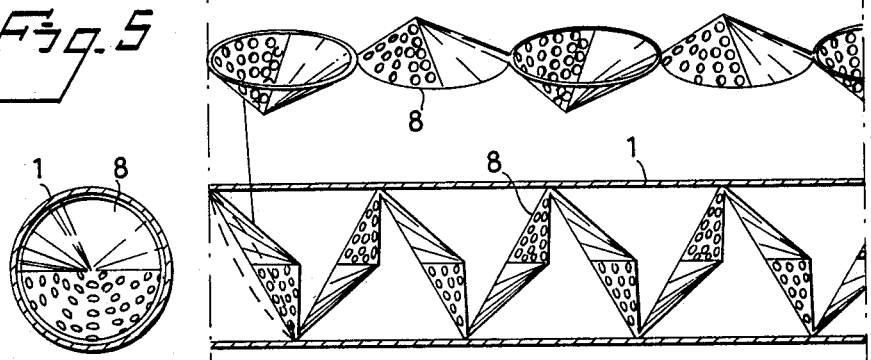
FIG. 5 shows in combination a perspective view of a third embodiment of an insert, said insert being arranged within the exhaust pipe, shown in longitudinal section, and also in cross-section.

A further alternative embodiment is shown in FIG. 5, and comprises of a strip of internally connected conical circular blanks 8, with adjacently located circular blanks shown having an opposed conicity in relation to each other. Otherwise, this embodiment corresponds to FIG. 4, i.e. each circular blank has part of the surface perforated, installation into the exhaust pipe 1 is performed with a zig-zag-shaped bent extension, and attachment is accomplished as described with reference to FIG. 4.

Figure 6:
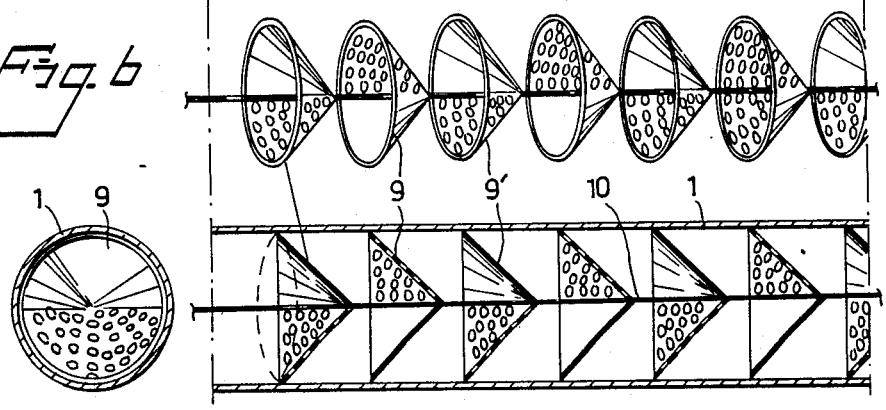
FIG. 6 shows combined views corresponding to FIG. 5 of a fourth embodiment of an insert.

FIG. 6 shows an example of a further alternative embodiment, including a number of conical members, 9, 9', having part of the surface perforated, internally connected by means of a centrally extending thread or wire 10. The perforated portions of adjacently located conical members 9, 9' are alternatively turned in relation to each other, in order to accomplish a continuously changed flow path for the exhaust fumes. The conical members 9, 9' will receive a favourable grip against the internal surface of the exhaust pipe 1, and obviously also against the corrugated portions 3, 3'.

It should also be mentioned, that a thread or wire 10 of the type mentioned with reference to the embodiment described with reference to FIG. 6 obviously also can be used in connection with the embodiments described with reference to FIGS. 4 and 5. Such a thread or wire 10 may then be arranged connected to an outer circular blank, 7 and 8 respectively, and by applying a stretching force against an outer circular blank at the opposed end portion of the insert 4, the circular blanks 7, 8 are forced to take up a more adjacent position, whereby the grip of the insert 4 against the internal surface of the exhaust pipe 1 is further improved.

The examples of embodiments of inserts 4 shown and described can obviously be further varied in a number of ways, and shown embodiments may thus be combined with each other, but shown configurations may also be further modifid. Shown perforations may thus be replaced by through recesses having other configuration, and also by peripheral removed portions. When included parts are joined by means of at least one thread or wire 10, said parts may also be arranged having a configuration different from the conical parts 9, 9' shown in FIG. 6. Furthermore, the embodiments shown in FIGS. 4–6, as well as modifications thereof, can also be used in combination with previously described cushion-shaped parts 5, 5', and such cushion-shaped parts 5, 5' can also be used internally connected to each other. The inserts can always completely or partly be arranged having a coating of platinum or platinum-rhodium, as well as other type of catalytic materials, in order to achieve catalytic purification of the exhaust fumes.

With reference to the non-corrugated portion denominated A, which has been described as a lower portion in the exhaust system, same results in that condensated liquid products are easily drained from the exhaust system, and that same also move with the exhaust fumes flowing through the exhaust system. Any joints do not exist, and the exhaust system comprises of a single member, completely without area changes which result in th formation of "pockets" where corrosive damage occurs due to collected condensated products. By manufacturing the exhaust system from a stainless steel material, good resistance against corrosive damage is accomplished, and the costs for a complete exhaust system is also low, since only a suitable pipe length/insert length are required for intended application. The weight of the exhaust system according to the invention can also be maintained low, since utilized material thickness is considerably less than conventional types of exhaust systems.

By suitable selection of the type of insert 4, and the length of same, it is also possible to adapt the counter-pressure of the exhaust system to achieve maximum effect for the connected engine within a specified range of revolutions. Such an adaption of the counter-pressure for an exhaust system is today carried out by supplying relatively expensive tuned exhaust systems, which normally only are used for car sports. A corresponding tuning operation is easily performed for an exhaust system according to the present invention, and suitable data for type of insert 4, and the length of same, can be supplied as a table covering various types of existing car models.

Obviously, an insert 4 can also be removed from the surrounding exhaust pipe 1, if required, and cushion-shaped parts 5, 5' filled with bodies of ceramic material, coated by platinum or similar material, can thus be removed, cleaned or left for reprocessing of the coating whereby the bodies perform catalytic purification of the exhaust fumes.

Shown and described examples of embodiments of an exhaust system according to the invention are only intended to serve as non-restricting examples of embodiments within the scope of the inventive thought and the following claims, since, as previously mentioned, further modifications obviously are possible.

I claim:

1. An exhaust system for a combustion engine comprising a longitudinally extending tubular member having a first end portion for connection to an exhaust manifold of a combustion engine and having, in a direction away from the first portion, a plurality of alternating smooth portions and circumferentially corrugated portions thereon and including an air permeable sound damping insert inside the tubular member which extends along the length of the tubular member.

2. The exhaust system according to claim 1, wherein the insert includes an exhaust fume purifying catalyst.

3. The exhaust system according to claim 2, wherein the catalyst is provided in the form of a coating at locations spaced along the length of the insert and the catalyst is of a material selected from platinum and platinum-rhodium.

4. The exhaust system according to claim 1, wherein the corrugated portions have mutually aligned non-corrugated portions extending therethrough, which non-corrugated portions, together with the said smooth portions, form a continuous smooth part extending along the length of the tubular member.

5. The exhaust system according to claim 1, wherein the insert is held in position by frictional contact between the insert and the surrounding tubular member.

6. The exhaust system according to claim 1, wherein the insert is resilient in a longitudinal direction.

7. The exhaust system according to claim 6, wherein the insert comprises a metal strip twisted into a helical shape.

8. The exhaust system according to claim 7, wherein the metal strip is perforated.

9. The exhaust system according to claim 7, wherein a plurality of cushion-shaped parts, in the form of resilient cylindrical members of a woven thread-shaped material, are spaced along the metal strip.

10. The exhaust system according to claim 9, wherein the spacing between successive pairs of cushion-shaped members is uneven.

11. The exhaust system according to claim 6, wherein the insert comprises a strip formed of a plurality of interconnected planar parts, which strip is bent into a zig-zag configuration in a longitudinal direction.

12. The exhaust system according to claim 11, wherein the planar parts are perforated.

13. The exhaust system according to claim 6, wherein the insert comprises a strip formed of a plurality of conical parts connected together in a side by side relationship at their opened ends, which strip is bent into a zig-zag configuration in a longitudinal direction.

14. The exhaust system according to claim 13, wherein the conical parts are perforated.

15. The exhaust system according to claim 1, wherein the insert comprises a string of washer-shaped parts interconnected in spaced relationship by means of a thread or wire.

16. The exhaust system according to claim 15, wherein the washer-shaped parts are perforated.

17. The exhaust system according to claim 15, wherein the washer-shaped parts are conically-shaped.

18. The exhaust system according to claim 1, wherein the insert comprises a plurality of cushion-shaped parts, in the form of resilient cylindrical members of a woven thread-shaped material, which are supported by and are spaced along the length of a longitudinal support member.

19. The exhaust system according to claim 1, wherein the support member includes bodies having a spherical shape.

20. The exhaust system according to claim 1, wherein the support member includes at least one body of a tubular shape.

21. The exhaust system according to claim 1, wherein the support member is of a thread shaped material.

* * * * *